US007497206B2

(12) United States Patent
Kemmer

(10) Patent No.: US 7,497,206 B2
(45) **Date of Patent: *Mar. 3, 2009**

(54) METHOD FOR OPERATING AN INTERNAL COMBUSTION ENGINE

(75) Inventor: Helerson Kemmer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 135 days.

This patent is subject to a terminal disclaimer.

(21) Appl. No.: 10/587,764

(22) PCT Filed: Nov. 17, 2005

(86) PCT No.: PCT/EP2005/056033

§ 371 (c)(1),
(2), (4) Date: Jul. 28, 2006

(87) PCT Pub. No.: WO2006/069848

PCT Pub. Date: Jul. 6, 2006

(65) Prior Publication Data

US 2007/0157906 A1 Jul. 12, 2007

(30) Foreign Application Priority Data

Dec. 28, 2004 (DE) ..... 10 2004 063 079

(51) Int. Cl.
*F02M 51/00* (2006.01)

(52) U.S. Cl. ..... 123/490; 361/154

(58) Field of Classification Search ..... 123/490; 36/152–153, 154–156
See application file for complete search history.

(56) References Cited

U.S. PATENT DOCUMENTS 4,729,056 A * 3/1988 Edwards et al. ..... 361/153
6,031,707 A * 2/2000 Meyer ..... 361/153
6,250,286 B1 * 6/2001 Hoenig et al. ..... 123/490
6,360,725 B1 * 3/2002 Scherrbacher ..... 123/490
6,571,773 B1 * 6/2003 Yamakado et al. ..... 123/490
6,785,112 B2 8/2004 Reischl et al.
7,252,072 B2 * 8/2007 Slater et al. ..... 123/479
7,360,526 B2 * 4/2008 Kemmer ..... 123/490
2003/0010325 A1 * 1/2003 Reischl et al. ..... 123/490
2004/0040545 A1 * 3/2004 Nasu ..... 123/490

(Continued)

FOREIGN PATENT DOCUMENTS

DE 198 33 830 2/2000

(Continued)

*Primary Examiner*—Stephen K Cronin
*Assistant Examiner*—Sizo B Vilakazi
(74) *Attorney, Agent, or Firm*—Michael J. Striker

(57) ABSTRACT

With a method for operating an internal combustion engine with a fuel injector (18) that is opened and closed electrically, a booster capacitor (BK) serving to increase the current intensity when the fuel injector (18) is opened, reliable fuel injection is ensured, even in extreme cases, such as resumption of fuel injection after an overrun condition, and in a starting procedure after a shutoff phase that is accompanied by an increase in pressure in the high pressure fuel system due to the fuel heating up, when booster capacitors are used that were designed for normal operation, by switching the current profile in certain operating states of the internal combustion engine from a standard value to an increased value and/or to a longer duration and, when the certain operating state ends, by resetting it to the standard value and the standard duration.

9 Claims, 2 Drawing Sheets

U.S. PATENT DOCUMENTS

2006/0075994 A1* 4/2006 Santero et al. ..... 123/490

FOREIGN PATENT DOCUMENTS

DE 100 14 228 9/2001
EP 1 072 779 1/2001
EP 1 286 034 2/2003
EP 1 396 630 3/2004

* cited by examiner

METHOD FOR OPERATING AN INTERNAL COMBUSTION ENGINE

CROSS-REFERENCE

The invention described and claimed hereinbelow is also described in PCT/EP 2005/056033, filed on Nov. 17, 2005 and DE 102004063079.8, filed Dec. 28, 2004. This German Patent Application, whose subject matter is incorporated here by reference, provides the basis for a claim of priority of invention under 35 U.S.C. 119 (a)-(d).

BACKGROUND OF THE INVENTION

The present invention relates to an internal combustion engine and a method for operating it.

To open an inwardly opening, high-pressure fuel injection solenoid valve used with gasoline direct injection, the high system pressure makes it necessary to include a booster phase, in which the current flowing through the high pressure injector increases to values such as 12 A. The high current is generated by connecting the high pressure injector to a booster capacitor that stores energy with a voltage of, e.g., 65 V, and delivers it to the high pressure injector during the booster phase. The energy withdrawn in the booster phase is resupplied to the booster capacitor by a reload circuit before the next booster phase. The size of this reload circuit and the booster capacitor depends, among other things, on the booster energy required by the high pressure injector which, in turn, depends on the booster current required to open the high pressure injector. The level of the booster current is determined primarily by the maximum system pressure against which the high pressure injector must open, and by the static flow rate.

The highest system pressure that exists during normal operation in systems with gasoline direct injection is determined by opening a pressure-limiting valve. The opening pressure of the pressure-limiting value is attained in two cases of normal operation. The first case is a hot start, i.e., a starting procedure after a shutoff phase, which is accompanied by an increase in pressure in the high pressure fuel system due to the fuel heating up. The fuel in the fuel system is heated up the by the heat transferred from an engine that had been previously driven under full load and was therefore heated up to an extreme extent. The second case is the resumption of fuel injection after an overrun condition. In an overrun condition, fuel injection is halted, and pressure increases in the high pressure fuel system for the reason given above. In both cases, the pressure in the high pressure fuel system is lowered after a few injections to a normal, lower pressure level. The booster current is designed in accordance with the maximum attainable pressure, however, which is the opening pressure of the pressure-limiting valve. This means that the reload circuit and the booster capacitor are oversized for normal operation.

The object of the present invention, therefore, is to provide a method that ensures reliable injection, even in extreme cases, such as resumption of fuel injection after an overrun condition, and in a starting procedure after a shutoff phase that is accompanied by an increase in pressure in the high pressure fuel system due to the fuel heating up, when booster capacitors are used that were designed for normal operation.

SUMMARY OF THE INVENTION

This problem is solved using a method for operating an internal combustion engine with a fuel injector that is opened and closed electrically. A booster capacitor serves to increase the current intensity when the fuel injector is opened. The current profile of the booster current is switched—in certain operating states of the internal combustion engine—from a standard value to an increased value and/or to a longer duration and, when the certain operating state ends, the current profile of the booster current is reset to the standard value and the standard duration. During a starting procedure of the internal combustion engine and/or when fuel injection is resumed after an overrun condition, the current profile of the booster current is preferably switched from the standard value to the extended booster phase and, when the starting procedure ends and after a few injections have been carried out after fuel injection has been restored after an overrun condition, the current profile of the booster current is reset to the standard value or the standard duration of the booster phase. The current profile of the booster current is preferably switched to an overall longer duration using multiple booster pulses, i.e., by repeatedly switching on the booster current for a short period each time.

The opening pressure of the high pressure injectors is increased by changing the booster current for the two cases described above. The change in the booster current must be restored quickly when the fuel pressure falls, to prevent a deep discharge of the booster capacitor. Since only a few fuel injections are carried out with the changed booster current, the discharge of the booster capacitor is minimal, which ensures that further fuel injections can be carried out. A further advantage is the fact that the reload circuit and the booster capacitor can be sized for normal operation. It is not necessary to oversize them for the hot start and resumption after overrun fuel cutoff. Furthermore, the opening force of the high pressure injector can be increased (e.g., by increasing the static flow rate of the valve) without changing the hardware. By using a greater static flow rate, a supercharged version of an engine series can be served, for example, and/or the power loss in the electronic control unit caused, e.g., by a shortening of the fuel injection window, can be reduced. When the static flow rate is greater, the start-up behavior at low temperatures is also improved.

The current profile is generally changed at start-up, so that the high pressure injectors are guaranteed to open until the opening pressure of the pressure-limiting value is reached. At the end of the starting procedure, the current profile is reactivated for normal operation. Due to the low speed at start-up, the reload circuit can sufficiently boost the booster capacitor, even though the booster energy demand of the changed current profile has increased. If the system pressure exceeds a certain pressure threshold in overrun, the current profile is changed for the subsequent resumption phase. The first fuel injections in the resumption phase will then require a greater amount of booster energy.

The switch between the standard value and the increased value preferably takes place within one fuel injection cycle.

The current profile of the booster current is preferably switched from the increased value to the standard value, or from the extended duration to the standard duration when the rail pressure falls below a threshold. As an alternative or in addition, it can be provided that the current profile of the booster current is switched from the increased value to the standard value, or from the extended duration to the standard duration when the number of fuel injections with the increased value of the booster current exceeds a maximum value.

As an alternative or in addition, it can also be provided that the current profile of the booster current is switched from the increased value to the standard value, or from the extended duration to the standard duration as soon as the voltage of the booster capacitor falls below a lower threshold.

Therefore, as soon as the system pressure falls below the pressure threshold again, or as soon as the number of fuel injections carried out with the changed current profile falls exceeds a certain threshold, the current profile is quickly reset to the original, lower level. This therefore prevents the booster capacitor from becoming deeply discharged, which could result in fuel injection failures.

The problem described initially is also solved by providing an internal combustion engine with a fuel injector that can be opened and closed electrically, a reversible booster capacitor serving to increase the current intensity when the fuel injector is opened, characterized by the fact that the current profile of the booster current is switchable from a standard value to an increased value and/or to a longer duration. The booster capacitor is preferably charged by a reload circuit.

BRIEF DESCRIPTION OF THE DRAWINGS

An exemplary embodiment of the present invention is explained below in greater detail with reference to the attached drawing.

DETAILED DESCRIPTION OF THE PREFERRED EMBODIMENTS

Figure 1:
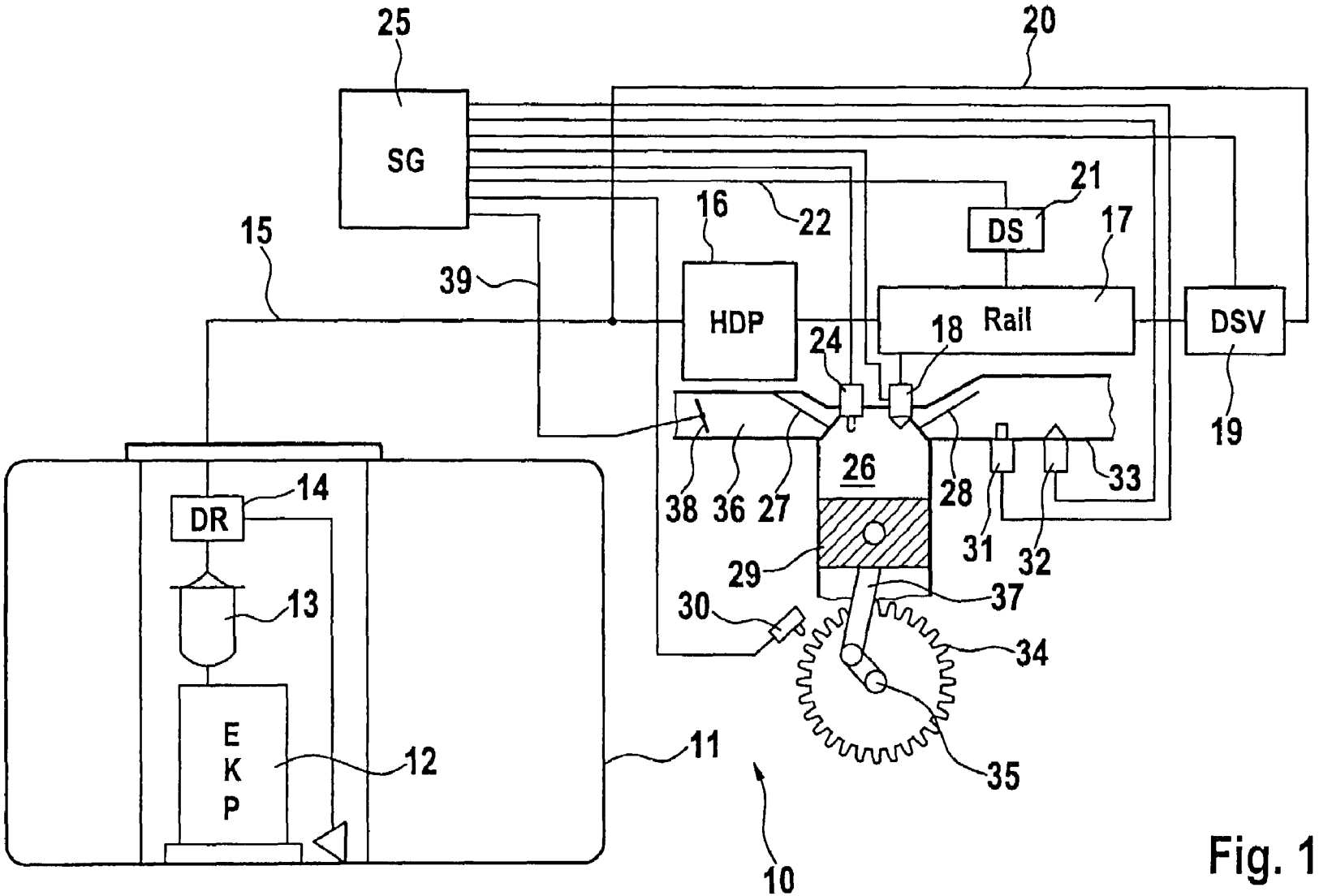
FIG. 1 shows a schematic depiction of a cylinder of an internal combustion engine with a fuel supply system.

FIG. 1 shows a schematic depiction of a cylinder of an internal combustion engine with associated components of the fuel supply system. The figure shows an internal combustion engine with direct injection (gasoline direct injection, DI) with a fuel tank 11, on which electric fuel pump (EKP) 12, a fuel filter 13 and a low pressure regulator 14 are located. From fuel tank 11, a fuel line 15 leads to a high pressure pump 16. Storage chamber 17 is connected to high pressure pump 16. Fuel injectors 18 are located on storage chamber 17, fuel injectors 18 preferably being assigned directly to combustion chambers 26 of the internal combustion engine. With internal combustion engines with direct injection, at least one fuel injector 18 is assigned to each combustion chamber 26, although a plurality of fuel injectors 18 can also be provided for each combustion chamber 26. The fuel is pumped by electric fuel pump 12 out of fuel tank 11 through fuel filter 13 and fuel line 15 to high pressure pump 16. Fuel filter 13 removes foreign particles from the fuel. With the aid of low pressure regulator 14, the fuel pressure is regulated in a low pressure area of the fuel supply system to a predetermined value, which is usually in the magnitude of approximately 4 to 5 bar. High pressure pump 16, which is preferably driven directly by the internal combustion engine, compresses the fuel and pumps it into storage chamber 17. The fuel pressure reaches values of up to approximately 150 bar. A combustion chamber 26 of an internal combustion engine with direct injection is shown in FIG. 1 as an example. The internal combustion engine generally includes a plurality of cylinders, each with its own combustion chamber 26. At least one fuel injector 18, at least one spark plug 24, at least one intake valve 27, and at least one exhaust valve 28 are located on combustion chamber 26. The combustion chamber is limited by a piston 29 that can move up and down in the cylinder. Through intake valve 27, fresh air is drawn out of an induction tract 36 into combustion chamber 26. With the aid of injection valve 18, the fuel is injected directly into combustion chamber 26 of the internal combustion engine. The fuel-air mixture is ignited using spark plug 24. The expansion of the ignited fuel-air mixture drives piston 29. The motion of piston 29 is transferred via a connecting rod 37 to a crankshaft 35. A segment disk 34 that is scanned by a speed sensor 30 is located on crankshaft 35. Speed sensor 30 produces a signal that characterizes the rotary motion of crankshaft 35.

The exhaust gasses produced during combustion leave combustion chamber 26 via exhaust valve 28 and enter exhaust pipe 33, in which a temperature sensor 31 and a lambda probe 32 are located. The temperature is detected with the aid of temperature sensor 31, and the oxygen content in the exhaust gasses is detected with the aid of lambda probe 32.

A pressure sensor 21 and a pressure control valve 19 are connected to storage chamber 17. Pressure control valve 19 is connected at the inlet side with storage chamber 17. On the outlet side, a return line 20 returns to fuel line 15. A throttle valve 38 is located in induction tract 36, the rotary position of which is adjustable using electronic control unit 25 via a signal line 39 and an associated electric actuator, which is not shown here.

Figure 2:
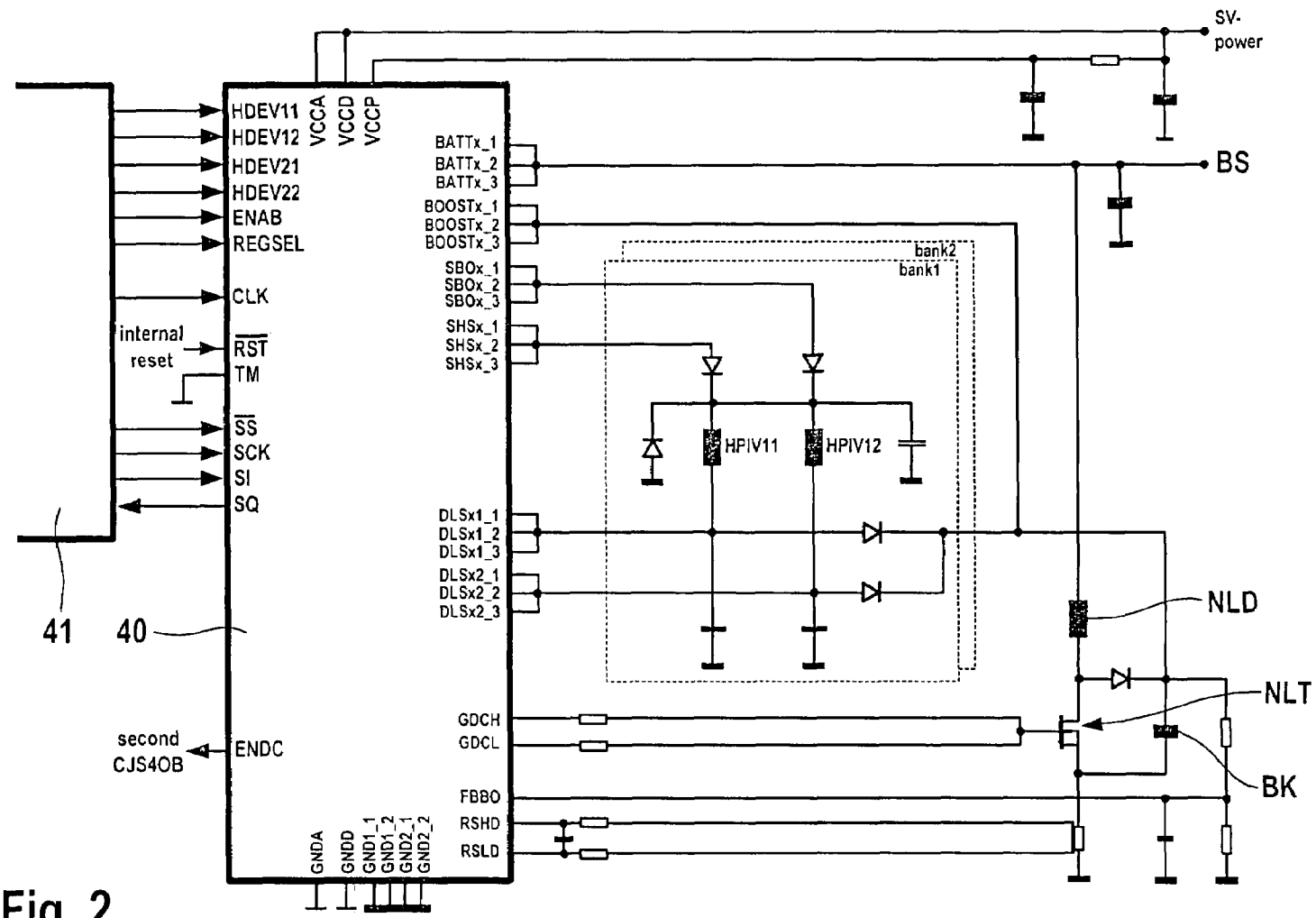
FIG. 2 shows a sketched circuit diagram with electronic control unit and injection nozzles.

Instead of a pressure control valve 19, a fuel supply control valve can also be used in fuel supply system 10. With the aid of pressure sensor 21, the actual value of the fuel pressure in storage chamber 17 is detected and fed to an electronic control unit 25. Using electronic control unit 25, a control signal is created based on the detected actual value of the fuel pressure and is used to control the pressure control valve. The electrical control of fuel injectors 18 is not shown in FIG. 1, it is depicted in FIG. 2. The various actuators and sensors are connected with electronic control unit 25 via control signal lines 22. Various functions that serve to control the internal combustion engines are implemented in electronic control unit 25. In modern electronic control units, these functions are programmed on a computer and are subsequently stored in a memory of electronic control unit 25. The functions stored in the memory are activated depending on the requirements of the internal combustion engine; strict requirements are placed on the real-time capability of electronic control unit 25 in particular. In principle, a pure hardware realization of the control of the internal combustion engine is possible as an alternative to a software realization.

The connection of the fuel injectors, which are labeled HPIV 11 and HPIV 12 in this case, with electronic control device 25 is shown in FIG. 2. For simplicity, the indices of outputs BATTX, BOOSTX, SPOX, SHSX, DLSX1 and DLSX2—each of which is present in triplicate—are not included in the depiction below. The sketch shows, as an example, a four-cylinder engine with two banks, labeled bank 1 and bank 2 in this case, although only bank 1 is presented in greater detail. In this case, electronic control unit 25 includes an output stage 40 for controlling fuel injectors HPIV 11 and HPIV 12, and a microcontroller 41 for controlling the functions of electronic control unit 25. The control of fuel injectors HPIV 11 and HPIV 12 is carried out such that output stage 40 activates signals BOOSTx_1 through BOOSTx_3 to SBOx_1 through SBOx_3 in the booster phase, it activates DLSX1_1 through DLSX1_3 to control HPIV11 to ground. As a result, a strong current flows through HPIV11. The necessary booster current is taken from a booster capacitor BK via inputs BOOSTX_1, etc. Booster capacitor BK is discharged every time one of the fuel injectors opens and, in the meantime, is discharged via a recharge choke NLD, which is connected to a battery supply voltage BS. A recharge transistor NLT serves to control the recharging process. In certain operating situations, e.g., when the internal combustion engine is started up, or when the overrun condition has ended, a higher current is required to open the particular fuel injector in the booster phase. It is attained by extending the booster phase, either by increasing the level of booster current to be attained or by applying multiple booster pulses, i.e., the connection between BOOSTx_1 through BOOSTx_3 and SBOx_1 through SBOx_3 is activated and deactivated a couple of times.

After the booster phase, output stage 40 activates signals BATTx_1 through BATTx_3 to SHSx_1 through SHSx_3, and it connects DLSX1_1 through DLSX1_3 for controlling HPIV11 to ground. As a result, a smaller current flows through HPIV11 in the holding phase. Output SHSX supplies a basic voltage to open the valve.

The booster current level can be adjusted in steps by microcontroller 31, e.g., between 8.5 and 12 amperes, in increments of 0.5 amperes. If the booster current level is set so high that the booster voltage in the booster capacitor BK cannot be maintained for an extended duration via recharging, the booster capacitor is discharged fully within a few injection cycles. To prevent booster capacitor BK from discharging, the operation with a longer booster phase is limited to a few injections. The voltage of booster capacitor BK can be used for this purpose. When a lower limit is reached, normal operation is switched back to. The switchover to normal operation can also be prompted when a pressure threshold is fallen below. As an alternative, the switchover to normal operation can take place after a certain number of injections, whereby the number can depend on the operating state of the internal combustion engine, e.g., speed, load and the like.

What is claimed is:

1. A method for operating an internal combustion engine with a fuel injector (18) that is opened and closed electrically, a booster capacitor (BK) serving to increase the current intensity when the fuel injector (18) is opened, comprising the following steps:

switching a current profile of a booster current from a standard value to an increased value and/or to a longer duration in certain operating states of the internal combustion engine and, when the certain operating state ends, resetting the current profile to the standard value and the standard duration, wherein the current profile of the booster current is switched from the increased value or the longer duration to the standard value and the standard duration when the number of injections with the increased value of the booster current exceeds a maximum value.

2. The method as recited in claim 1, further comprising the step of switching the current profile of the booster current from the standard value to the increased value and/or to a longer duration during a starting procedure of the internal combustion engine and, upon transition back to normal operation, resetting the current profile to the standard value.

3. The method as recited in claim 1, wherein, further comprising the step of when an overrun condition ends, switching the current profile of the booster current is switched from the standard value to the increased value and/or to a longer duration, and, upon transition back to normal operation, it is reset to the standard value.

4. The method as recited in claim 1, wherein the current profile of the booster current is switched to a longer duration by applying multiple booster pulses.

5. The method as recited in one claim 1, wherein the switch between the standard value and the increased value takes place within one injection cycle.

6. The method as recited in one of the preceding claims, wherein the current profile of the booster current is switched from the increased value or the longer duration to the standard value and the standard duration when the rail pressure falls below a lower threshold.

7. The method as recited in claim 1, wherein the current profile of the booster current is switched from the increased value or the longer duration to the standard value and duration as soon as the voltage of the booster capacitor (BK) falls below a lower threshold.

8. An internal combustion engine with a fuel injector (18) that can be opened and closed electrically, a reversible booster capacitor (BK) serving to increase the current intensity when the fuel injector (18) is opened, wherein the current profile of the booster current is switchable from a standard value to an increased value and/or to a longer duration, wherein the current profile of the booster current is switched from the increased value or the longer duration to the standard value and the standard duration when the number of injections with the increased value of the booster current exceeds a maximum value

9. The internal combustion engine as recited in claim 8, wherein the booster capacitor (BK) is charged by a reload circuit (NLK).

* * * * *